US008327763B2

(12) United States Patent
Bünner et al.

(10) Patent No.: US 8,327,763 B2
(45) Date of Patent: Dec. 11, 2012

(54) PRINTING COUPLE OF A ROTARY PRINTING PRESS AND A METHOD FOR WASHING A DAMPENING UNIT OF A PRINTING COUPLE

(75) Inventors: Christian Bünner, Margetshöchheim (DE); Bernd Kurt Masuch, Kürnach (DE); Wolfgang Otto Reder, Veitshöchheim (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 811 days.

(21) Appl. No.: 12/449,067

(22) PCT Filed: Oct. 26, 2007

(86) PCT No.: PCT/EP2007/061545

§ 371 (c)(1), (2), (4) Date: Jul. 22, 2009

(87) PCT Pub. No.: WO2008/095551

PCT Pub. Date: Aug. 14, 2008

(65) Prior Publication Data

US 2010/0101436 A1 Apr. 29, 2010

(30) Foreign Application Priority Data

Feb. 7, 2007 (DE) ..... 10 2007 006 063
Aug. 31, 2007 (DE) ..... 10 2007 000 926

(51) Int. Cl.
*B41L 41/02* (2006.01)
*B41L 41/04* (2006.01)

(52) U.S. Cl. ..... 101/423; 101/425; 101/148; 101/350.1

(58) Field of Classification Search ..... 101/423
See application file for complete search history.

(56) References Cited

U.S. PATENT DOCUMENTS

| | | | | |
|---|---|---|---|---|
| 3,673,959 | A * | 7/1972 | Jezuit et al. | 101/148 |
| 3,701,316 | A | 10/1972 | Sylvester et al. | |
| 3,842,735 | A * | 10/1974 | Southam et al. | 101/145 |
| 4,036,131 | A | 7/1977 | Elmore | |
| 5,090,314 | A | 2/1992 | Miescher et al. | |
| 7,373,882 | B2 | 5/2008 | Heuschkel et al. | |
| 2006/0081139 | A1 | 4/2006 | Bolza-Schunemann | |
| 2006/0272527 | A1 | 12/2006 | Bernard et al. | |

(Continued)

FOREIGN PATENT DOCUMENTS

| | | |
|---|---|---|
| DE | 1 932 642 | 2/1966 |

(Continued)

*Primary Examiner* — Joshua D Zimmerman
(74) *Attorney, Agent, or Firm* — Mattingly & Malur, P.C.

(57) ABSTRACT

A printing unit of a rotary printing press includes a forme cylinder. An inking unit interacts with the forme cylinder and has a plurality of inking rolls. A dampening unit also interacts with the forme cylinder and has a plurality of dampening rolls. A washing device interacts with at least one of the inking rolls and dampening rolls for washing the inking unit and/or the dampening unit. The inking unit includes a plurality of ink applicator rolls which can be placed directly onto the forme cylinder during printing operation. The dampening unit has at least one dampening rotation applicator roll that can also be placed directly onto the forme cylinder during printing operations. In a washing position, one of the plurality of ink application rolls and the dampening rotation applicator roll are brought directly into contact with each other.

42 Claims, 5 Drawing Sheets

U.S. PATENT DOCUMENTS

| | | | |
|---|---|---|---|
| 2008/0163773 | A1 | 7/2008 | Schneider et al. |

FOREIGN PATENT DOCUMENTS

| | | | |
|---|---|---|---|
| DE | 2 301 692 | | 7/1974 |
| DE | 29 32 105 | | 2/1981 |
| DE | 40 12 283 | A1 | 10/1991 |
| DE | 10 2005 056 812 | A1 | 6/2006 |
| WO | WO 2004/054804 | A1 | 7/2004 |
| WO | WO 2005/007409 | A2 | 1/2005 |
| WO | WO 2006/100158 | A2 | 9/2006 |

* cited by examiner

PRINTING COUPLE OF A ROTARY PRINTING PRESS AND A METHOD FOR WASHING A DAMPENING UNIT OF A PRINTING COUPLE

CROSS-REFERENCE TO RELATED APPLICATIONS

This application is the U.S. national phase, under 35 U.S.C. 371, of PCT/EP2007/061545, filed Oct. 26, 2007; published as WO 2008/095551 A1 on Aug. 14, 2008 and claiming priority to DE 10 2007 006 063.9, filed Feb. 7, 2007 and to DE 10 2007 000 926.9 filed Aug. 31, 2007, the disclosures of which are expressly incorporated herein by reference.

FIELD OF THE INVENTION

The present invention is directed to a printing couple of a rotary printing press and to a method for washing a dampening unit of a printing couple. The printing couple includes a forme cylinder which is contacted by ink forme rollers of an inking unit and by at least one dampening forme roller during print operation. In a washing position, at least one of the ink forme rollers and the dampening forme roller are engaged directly against one another.

BACKGROUND OF THE INVENTION

DE 29 32 105 A1 describes an inking unit for an offset rotary printing press having two roller trains, three forme rollers, and a roller stand. The roller stand is displaceably disposed such that a distribution roller is either engaged against a third forme roller or is separated from the third forme roller during operation of the printing press.

In modern offset printing presses, inking units of printing couples are ordinarily equipped with washing devices that are operable to allow the inking unit to be cleaned as needed. To allow dampening units to also be washed in such printing presses, both the ink forme rollers and the dampening forme roller must be engaged against the plate cylinder. This will allow washing solution to be transferred from the inking unit onto the dampening unit. It is also necessary for the plate cylinder to be fully loaded with plates during such a washing procedure. During a production run involving a partially loaded plate cylinder, the missing plates must therefore be mounted onto the plate cylinder solely for the purpose of washing the dampening unit. This requirement and procedure is both inconvenient and time-consuming.

WO 2004/054804 A1 and WO 2005/007409 A2 both describe inking and dampening units with displaceable stripper rollers.

DE 10 2005 056 812 A1, DE 19 32 642 U and DE 40 12 283 A1 all disclose intermediate rollers that can be moved for washing.

U.S. Pat. No. 3,701,316 A and U.S. Pat. No. 4,036,131 A each disclose an inking unit and a dampening unit. A dampening forme roller can be engaged against an ink forme roller for the purpose of washing.

SUMMARY OF THE INVENTION

The object of the present invention is to provide a printing couple for a rotary printing press and to also provide a method for washing a dampening unit.

The object is attained in accordance with the present invention by the provision of a printing couple including a forme cylinder. The forme cylinder is directly engaged by a plurality of ink forme rollers during a printing operation. At least one dampening fluid roller is also engaged directly against the forme cylinder during the printing operation. A washing unit is used to wash one of an inking unit that includes the ink forme rollers and dampening unit that includes the at least one dampening fluid roller. During a washing operation, at least one of the ink forme rollers or the dampening forme roller can be displaced so that they are in direct engagement and act to form a shared roller train with the washing unit.

The benefits to be achieved with the present invention consist especially in that when the plate cylinder is only partially loaded, it is no longer necessary to mount the missing packings, such as, for example, printing plates, onto the plate cylinder in order to wash the dampening unit. This saves time and money.

A structurally simple and cost-effective configuration is produced by eliminating a supplementary stripper roller. Instead, configuring one of the already existing rollers of the inking unit or the dampening unit is configured to be displaceable, such as, for example, to be pivotable between an operating position, such as, for example, a printing position, and a washing position. When the displaceable roller is in the washing position, rollers of the inking unit and rollers of the dampening unit are connected to form a shared roller train.

BRIEF DESCRIPTION OF THE DRAWINGS

Preferred embodiments of the present invention are represented in the set of drawings and will be described in greater detail in what follows. The drawings show.

DESCRIPTION OF THE PREFERRED EMBODIMENTS

Figure 1:
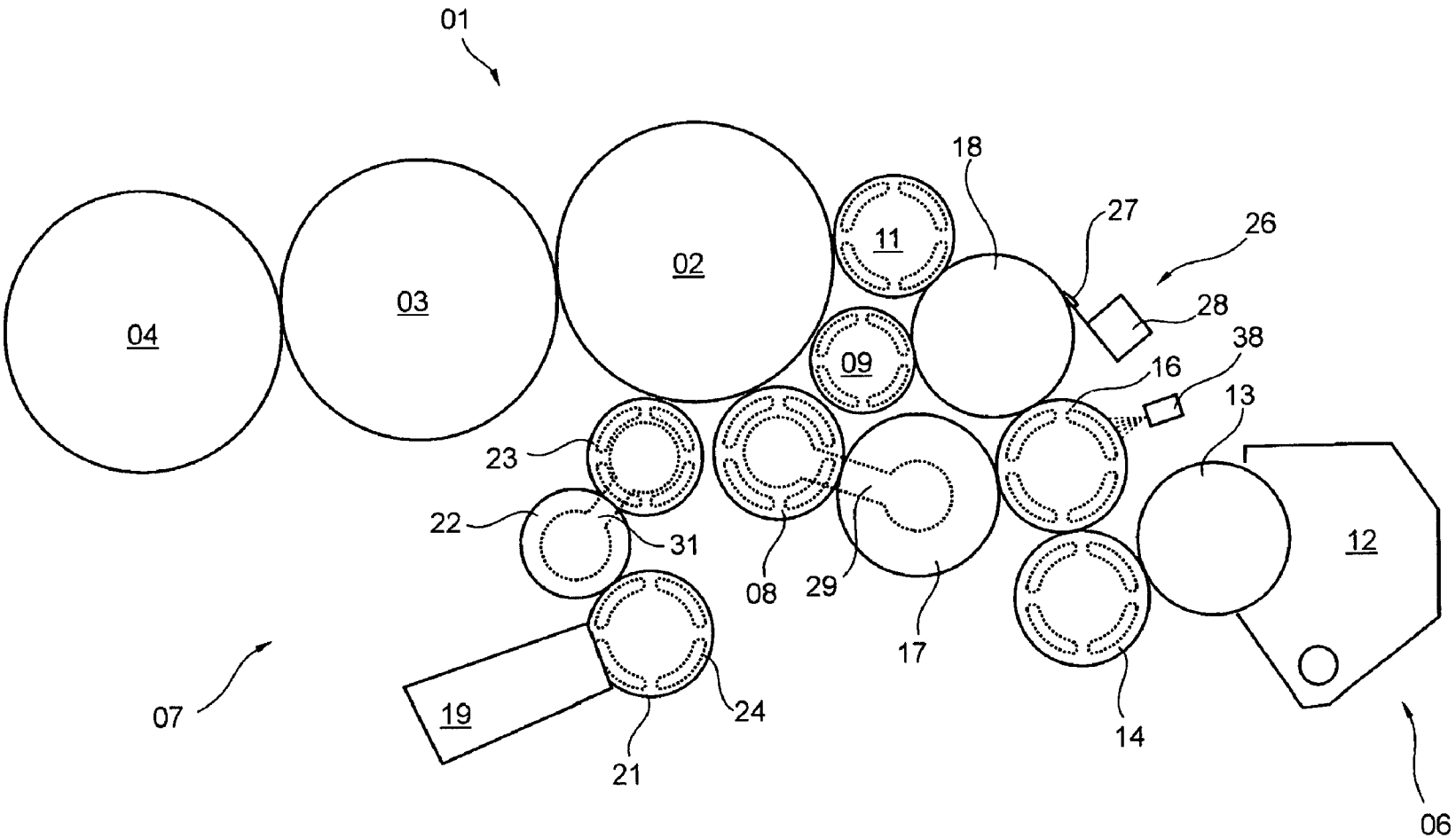
FIG. 1 a schematic side elevation view of a printing couple showing two alternative options for a displaceable roller, and showing the rollers of the inking unit and the rollers of the printing couple in the printing position.

Referring initially to FIG. 1, there may be seen a somewhat schematic representation of a printing couple 01 of a rotary printing press. The remainder of the rotary printing press, which is generally conventional, is not shown. The rotary printing press may be, for example, a web-fed rotary printing press, and especially may be a newspaper printing press which prints in the wet offset printing process, and may be for example, embodied as part of a printing tower. The printing couple 01 depicted in FIG. 1 can be one of four printing couples of a nine-cylinder satellite printing unit, for example. The other printing couples of the nine-cylinder satellite printing unit can be embodied accordingly. The printing couple 01 can be six plates wide, for example, with the axial length of the printing couple cylinders 02; 03 and 04 each being equal to the width of six printing plates. The printing couple cylinders 02; 03; 04 can each have a circumference of two printing plates, for example.

In the case of the preferred embodiment, the printing couple 01 includes a printing couple cylinder 02, which can be embodied as a forme cylinder 02, and especially which can be embodied as a plate cylinder 02. A printing couple cylinder 03, which cooperates with the forme cylinder 02, can be embodied as a transfer cylinder 03, and especially can be embodied as a blanket cylinder 03. An additional printing couple cylinder 04, which cooperates with the transfer cylinder 03, can be embodied as an impression cylinder 04, or in other words as a satellite cylinder 04 in the case of a nine-cylinder satellite printing unit. A web of print substrate, and especially a web of paper, which is not specifically shown here, is guided between the transfer cylinder 03 and the impression cylinder 04. The transfer cylinder 03 generates at least one print image, which it received from printing formes on the forme cylinder 02, on the web of paper with each rotation of the cylinders.

An inking unit 06 and a dampening unit 07 are both assigned to the forme cylinder 02. The inking unit 06 and the dampening unit 07 are situated close to one another. When the printing couple 01 is in the operating status, as is shown in FIG. 1, both the inking unit 06 and the dampening unit 07 are engaged against the forme cylinder 02 for a print operation of the printing couple 01.

The inking unit 06 has a plurality of rollers 08; 09; 11; 13; 14; 16; 17; 18 or of inking unit rollers 08; 09; 11; 13; 14; 16; 17; 18. Specifically, the inking unit 06 comprises three ink forme rollers 08; 09; 11, which are engaged against the forme cylinder 02 when the rotary printing press is executing a production process. Between an ink forme roller 13, such as an ink fountain roller 13, which picks up ink from an ink reservoir 12, and the ink forme rollers 08; 09; 11 which apply the ink to the forme cylinder 02, there are arranged a plurality of rollers 14; 16; 17; 18. The roller 14 that follows immediately after the ink fountain roller 13, in the direction of ink transport from the ink fountain roller to the forme cylinder 02 is embodied as an ink film roller 14. Downstream of the ink film roller 14, again in the direction of ink transport, a roller 16, which is embodied as an ink flow dividing roller 16 is provided. This ink flow dividing roller 16 divides an ink flow coming from the ink fountain roller 13 into a primary ink flow which leads over a roller 17, and a secondary flow which leads over a roller 18.

Roller 17 and roller 18 are embodied as ink flow distribution rollers 17; 18 which both transfer ink from the ink flow dividing roller 16, in a primary ink flow and in a secondary flow, respectively, each to at least one of the ink forme rollers 08; 09; 11. Each of the two ink flow distribution rollers 17; 18 executes an oscillating motion extending in its respective axial direction. The oscillating motion of the one ink flow distribution roller 17 can be coupled with the oscillating motion of the other ink flow distribution roller 18, for example via a lever assembly. In an alternative embodiment, the oscillating motion of the respective ink flow distribution rollers 17; 18 are generated using independent drives. In each of the two drive variations, the two axially oscillating motions can be directed opposite one another. The axial oscillating motion of each respective ink flow distribution roller 17; 18 can also be generated, for example, from its rotational motion through the provision of a suitable transmission.

In both the primary ink flow and the secondary ink flow, ink, which has been picked up from the ink reservoir 12, is applied to the forme cylinder 02 via a roller train that is comprised of five rollers 13; 14; 16; 17; 08 or 13; 14; 16; 18 and 09 or 11, arranged in a row. Each ink roller train, which is leading to the forme cylinder 02, is made up of the components which include the ink fountain roller 13, the ink film roller 14, the ink flow dividing roller 16, one of the ink flow distribution rollers 17; 18 and one of the ink forme rollers 08; 09; 11. Accordingly, only a single roller 14 is situated in the roller train between the ink fountain roller 13 and the ink flow dividing roller 16, with this single roller 14 being embodied as an ink film roller 14.

The ink reservoir 12, from which the ink fountain roller 13 picks up the ink to be transported to the forme cylinder 02, is embodied as an ink fountain 12 or as an ink trough 12. A plurality of ink blades, which are not specifically shown, such as, for example, thirty to sixty, such ink blades are provided in a row on the ink fountain 12 or the ink trough 12 in the axial direction of the ink fountain roller 13. Each such ink blade is adjustable, in terms of its respective engagement against the ink fountain roller 13, and is actually engaged against the ink fountain roller. Each such ink blade is adjustable, preferably remotely, via an adjustment mechanism, which is not specifically shown, thereby enabling a zonal metering of the ink which is being picked up by the ink fountain roller 13. The metering of the quantity of ink that may be produced by adjusting each respective ink blade, is manifested in an ink film thickness which is proportional to this adjustment of each ink blade in the relevant zone on the circumferential surface of the ink fountain roller 13. Accordingly, in the preferred embodiment depicted in FIG. 1, the inking unit 06 is structured as a zonal inking unit.

The lengths of the rollers 08; 09; 11; 13; 14; 16; 17; 18 of the inking unit 06, in their respective axial directions, ranges from 500 mm to 2,600 mm, for example, and especially ranges from 1,400 to 2,400 mm. Their external diameters range from 50 mm to 300 mm, for example, and preferably range from 80 mm to 250 mm. The circumferential surface of the ink flow dividing roller 16 is preferably made of a flexible material, such as, for example, a rubber material.

The dampening unit 07 has a plurality of rollers 21; 22; 23 or dampening unit rollers 21; 22; 23. It is preferably embodied as a dampening unit 07 which applies a dampening agent in a contactless manner, for example as a spray dampening unit 07. The dampening unit thus has a spray bar 19, in which a plurality of spray nozzles, which are arranged in the spray bar 19, preferably spray a dampening agent onto a roller 21 of the dampening unit 07, which roller 21 is embodied as a dampening distribution roller 21, for example. The dampening agent, that is sprayed onto the dampening distribution roller 21, is transferred by another roller 22 of the dampening unit 07, which is embodied as a dampening smoothing roller 22, for example, onto its roller 23, that is, in turn, embodied as a dampening forme roller 23, and from there to the forme cylinder 02. The dampening smoothing roller 22 is capable of executing an oscillating motion in its axial direction.

At least the printing couple cylinders 02; 03 are each mounted in linear bearings, which are not specifically shown here, and thus are understood as being able to be linearly movable in relation to the side frame of the printing press, which also is not shown here, in an approximately horizontal direction in the depiction of FIG. 1.

At least the ink forme rollers 08; 09; 11 of the inking unit 06 and the dampening forme roller 23 of the dampening unit 07, and preferably also the ink film roller 14 and the ink flow dividing roller 16 of the inking unit 06, and the dampening distribution roller 21 of the dampening unit 07 are each arranged so as to be capable of radial movement. The radial movement of these rollers 08; 09; 11; 14; 16; 21; 23 refers to the eccentric displacement of the respective axes of these rollers 08; 09; 11; 14; 16; 21; 23, or at least the eccentric displacement of one of the ends of these rollers 08; 09; 11; 14; 16; 21; 23, in relation to a bearing point belonging to the respective roller 08; 09; 11; 14; 16; 21; 23, and which is optionally fixed to the frame or, in the case of ink forme roller 08 or dampening forme roller 23, is displaceable in relation to the frame, for example pivotable, as will be discussed below. The eccentric displacement of each of the rollers 08; 09; 11; 14; 16; 21; 23 is accomplished with the help of preferably a plurality of actuators 24, preferably at least two such actuators 24, and for example by the provision of four such actuators 24, which are arranged symmetrically and concentrically around the respective axes of these rollers 08; 09; 11; 14; 16; 21; 23. The several actuators 24 that belong to the same roller 08; 09; 11; 14; 16; 21; 23 can be actuated individually and independently of one another by a control unit, and can be adjusted to a specific adjustment path. Each actuated actuator 24 exerts a radial force with respect to the roller 08; 09; 11; 14; 16; 21; 23 to which it is assigned. This radial force displaces, or at least attempts to displace, the axis of the respective roller 08; 09; 11; 14; 16; 21; 23 radially. When a plurality of actuators 24, which are all arranged at the same end of one of the rollers 08; 09; 11; 14; 16; 21; 23, are actuated simultaneously, the resulting radial movement, which is executed by the axis of the respective roller 08; 09; 11; 14; 16; 21; 23, is the vector sum of the respective radial forces of the plurality of actuated actuators 24.

The actuators 24 are individually pressurized by a pressure medium, for example. They are preferably each pneumatically actuated. Each of the actuators 24 is preferably situated in a roller socket within a structural unit, with each such roller socket accommodating one end of its one of the respective rollers 08; 09; 11; 14; 16; 21; 23. The radial movement that can be executed by the axis of the respective roller 08; 09; 11; 14; 16; 21; 23 preferably lies within the range of a few millimeters, such as, for example, up to 10 mm. This radial movement is sufficient to disengage the respective roller 08; 09; 11; 14; 16; 21; 23 from at least one adjacent cylindrical rotational body, such as, for example, from the forme cylinder 02. The respective actuators 24 each also adjust a level of contact pressure which is exerted by the respective roller 08; 09; 11; 14; 16; 21; 23 against its at least one adjacent rotational body. The degree of such an adjusted contact pressure influences the quality of the printed product produced in connection with this inking unit 06 and/or dampening unit 07 by influencing the transport of ink or of dampening agent that is controlled with this adjustment. The contact pressure builds up when there is direct contact between the respective roller 08; 09; 11; 14; 16; 21; 23 and its adjacent rotational body. However, by actuating one or more of the plurality of actuators 24, the at least one active radial force can be increased. With the continued or renewed actuation of one or more of these actuators 24, the amount of existing contact pressure can be adjusted, and, for example, can even be decreased.

Figure 2:
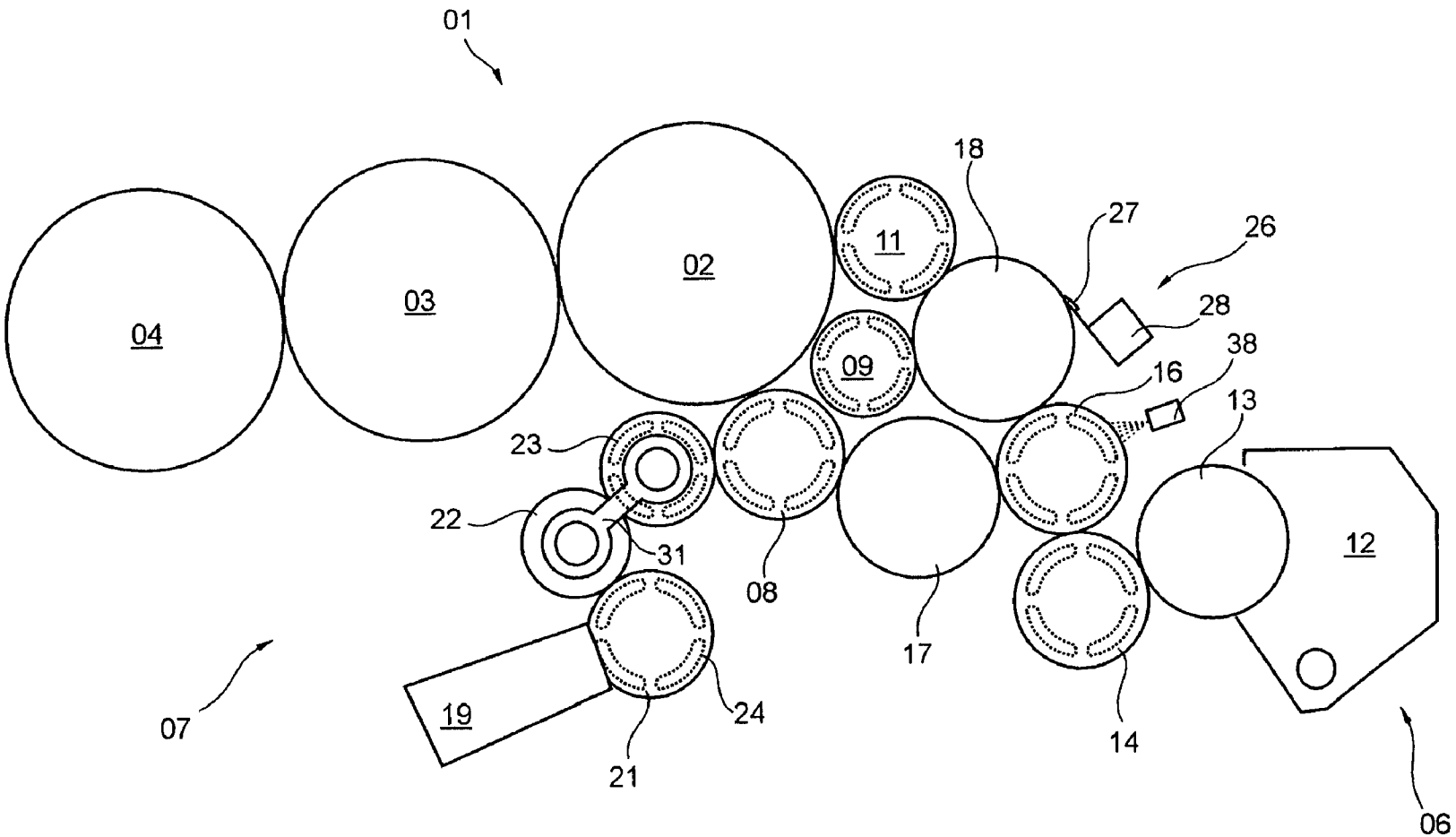
FIG. 2 a schematic side elevation view corresponding to that of FIG. 1, and in which a forme roller of the dampening unit is the displaceable roller and is shown in the displaced washing position.
Figure 3:
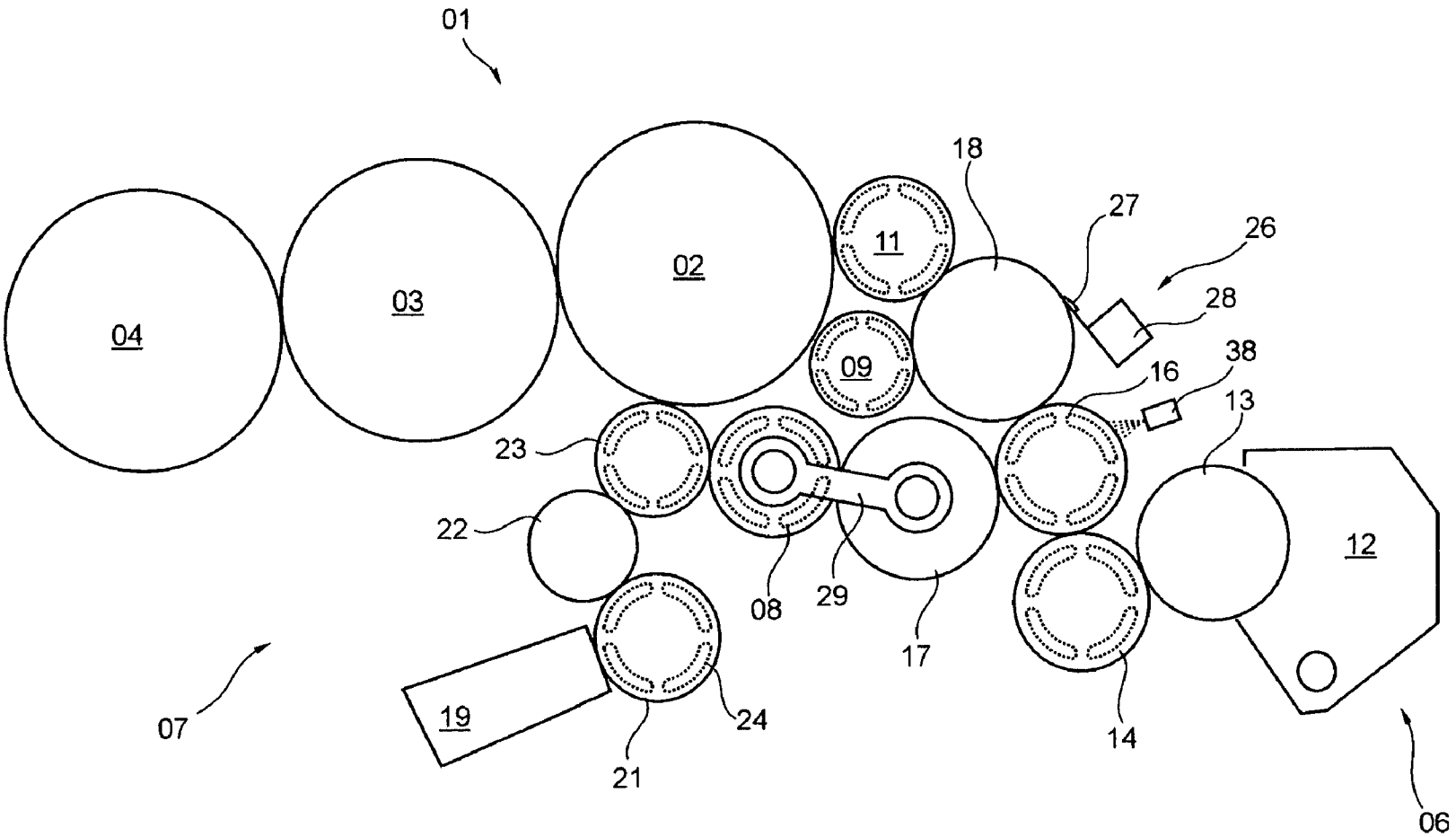
FIG. 3 a schematic side elevation view of an alternative embodiment of the present invention, in which a forme roller of the inking unit is the displaceable roller and is shown in the displaced washing position.
Figure 4:
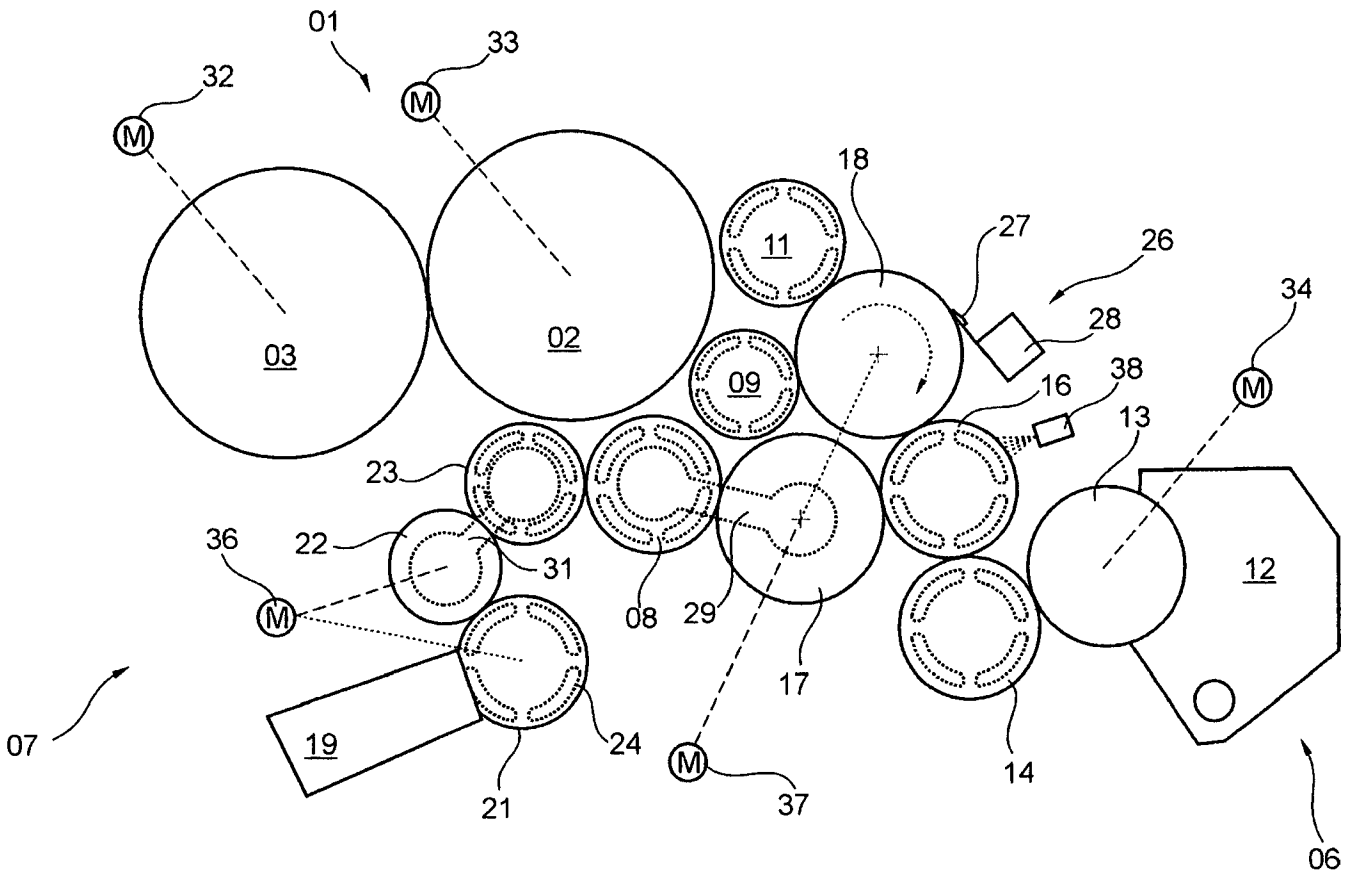
FIG. 4 a schematic side elevation view of the printing couple in an operating status in which all of forme rollers are in the position of disengagement from the forme cylinder.

FIG. 4 shows a drive arrangement for the printing couple 01, which drive arrangement can be implemented in all of the configurations of FIGS. 1 to 3, and which drive arrangement comprises drive motors 32; 33; 34; 36 and 37. It is apparent, from the depiction shown in FIG. 4, that the transfer cylinder 03 or the blanket cylinder 03 has its own motor 32. The forme cylinder 02 or plate cylinder 02 has its own motor 33. The ink fountain roller 13 has its own motor 34. At least the dampening smoothing roller 22 of the dampening unit 07 has its own motor 36. At least the ink flow distribution roller 17 of the inking unit 06 has its own motor 37. This standard configuration of the drive arrangement for the printing couple 01 is indicated in FIG. 4 by dashed lines extending outward from the respective drive motors 32; 33; 34; 36 and 37. An optional embodiment of the drive arrangement for printing couple 01, which is also indicated in FIG. 4 by a dotted line, provides for a single, shared motor 36 for dampening unit rollers 21 and 22 of the dampening unit 07, or, in other words, provides especially for a single shared motor for the dampening distribution roller 21 and the smoothing roller 22, and for a single, shared motor 37 for the two ink flow distribution rollers 17; 18 of the inking unit 06. In the case of the shared motor 37 for the two ink flow distribution rollers 17; 18, the secondary ink flow distribution roller 18 is driven together with the primary ink flow distribution roller 17 only in the rotational direction indicated in FIG. 4 by a dotted directional arrow. For driving in the opposite rotational direction, the secondary ink flow distribution roller 18 is uncoupled from the motor 37 that drives at least the primary ink flow distribution roller 17. The dotted directional arrow in FIG. 4 indicates the direction of rotation of the secondary ink flow distribution roller 18 in which a washing process, which will be described further below, will be performed in the inking unit 06 and/or in the dampening unit 07. The direction of rotation of the secondary ink flow distribution roller 18, that is opposite to the directional arrow shown in dotted lines in FIG. 4, is the direction of rotation of the secondary ink flow distribution roller 18 when the printing couple 01 is executing a production process, in which production process, ink is transported in the inking unit 06 from the ink reservoir 12 to the forme cylinder 02.

Figure 5:
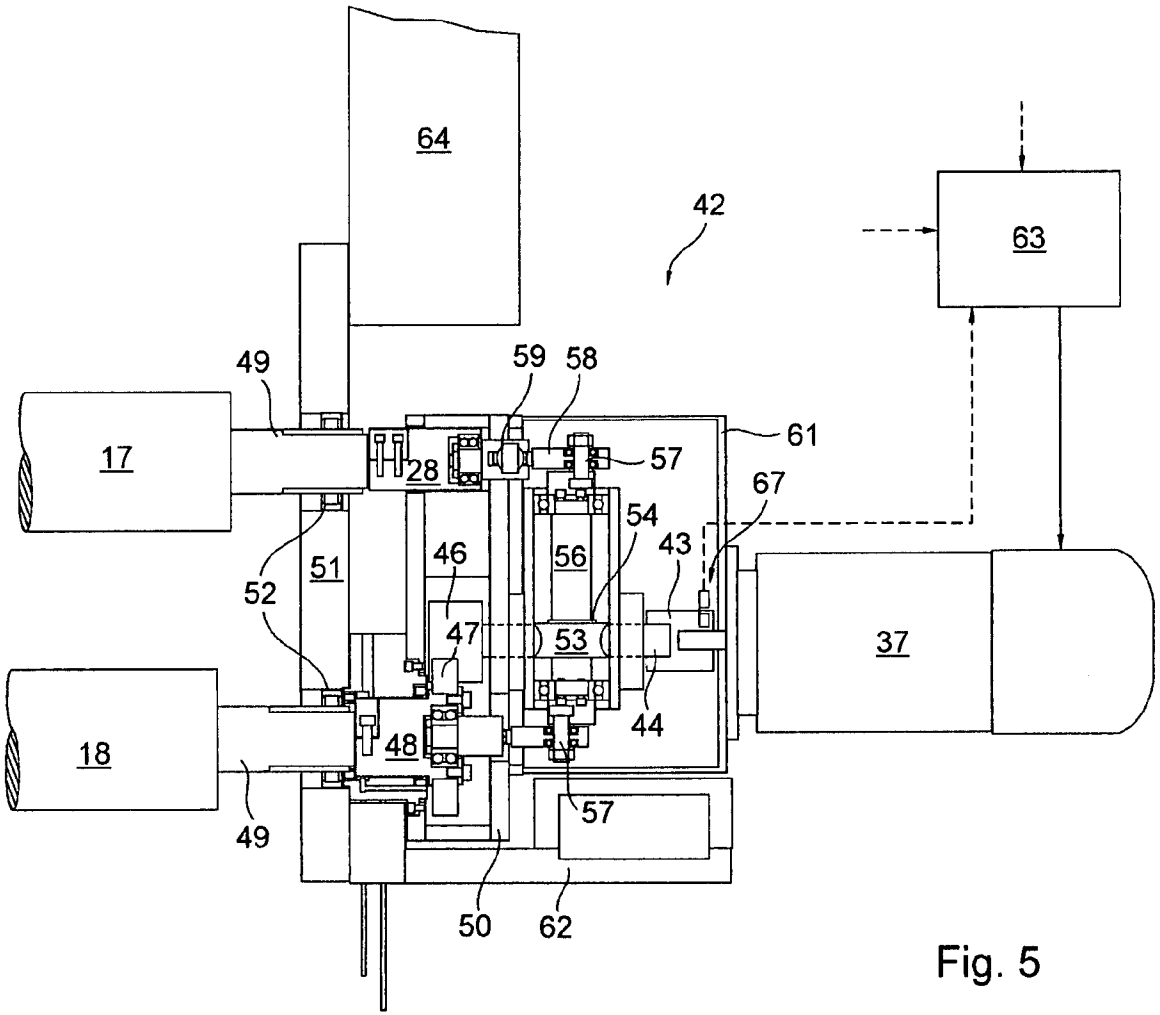
FIG. 5 an embodiment of a drive for the distribution cylinder of the inking unit.

The axial movement of the two ink flow distribution rollers 17; 18 and/or at least the rotation of one or of both of the ink flow distribution rollers 17; 18 can be actuated via a coupled transmission, such as, for example, via a transmission as is shown in FIG. 5 and as will be described in greater detail in the discussion that follows. FIG. 5 shows an advantageous embodiment of the drive for the ink flow distribution rollers 17; 18. Only the secondary ink flow distribution roller 18 is positively rotationally driven. Both of the ink flow distribution rollers 17; 18 are positively axially driven via a shared oscillating drive 42.

The drive motor 37, which is depicted schematically in FIG. 4, drives a drive sprocket 46 via a coupling 43 and a shaft 44. The drive sprocket 46, in turn, cooperates with a spur gear 47 which is non-rotatably connected to the secondary ink flow distribution roller 18. This connection can be made with a journal 49 of the distribution roller 18, for example via an axle segment 48 that supports the spur gear 47. A corresponding axle segment 48 of the distribution roller 17 has no such spur gear 47 and no drive connection with the drive motor 37. The drive connection between drive sprocket 46 and spur gear 47 of the secondary ink flow distribution roller 18 is preferably evenly toothed and is embodied with a sufficiently high contact ratio, with respect to tooth engagement, for every position of the oscillating movement.

The two ink flow distribution rollers 17; 18 are each mounted in a side frame 51 in bearings 52, such as, for example, in radial bearings 52, which also enable axial movement. No rotational drive connection exists between the drive motor 37 and the primary ink flow distribution roller 17 in this case. The drive sprocket 46 and the spur gear 47, which are situated on the axle segment 48, together form a transmission, and especially form a reduction gearset, for the rotational drive, which can be a separate closed and/or preassembled component with its own housing 50. This component can be coupled at the output side with the journal 49 of the secondary ink distribution roller 18.

The oscillating drive 42 is also driven by the drive motor 37, such as, for example, by the use of a worm gear system 53; 54. In this case, actuation is accomplished by a worm 53, or by a segment of the shaft 44 being embodied as a worm 53, on a worm gear 54, which worm gear 54 is non-rotatably connected to a shaft 56, which extends perpendicular to the rotational axis of the ink flow distribution rollers 17; 18. A driver 57 is arranged at each end surface of the shaft 56, and eccentrically to the rotational axis of shaft 56. Each such driver 57 is connected, rigid to compression and to tension in the axial direction of the ink flow distribution rollers 17; 18, to the journal 49 of the respective one of the ink flow distribution rollers 17; 18, for example via a crank mechanism, such as, for example, via a lever 58, which is rotatably mounted on the driver 57, and a joint 59. Rotating the shaft 56 causes the driver 57 to rotate, which in turn elicits axial movement of the ink flow distribution rollers 17; 18 via the crank mechanism.

The oscillating drive 42 or the oscillating transmission 42 is embodied as a complete structural unit with its own housing 61, which housing 61 can also be encapsulated in configuration. The oscillating transmission 42 can be lubricated, inside the encapsulated chamber, with oil or, preferably, with grease. The oscillating transmission 42, in the embodiment represented in FIG. 5, is supported by a support 62 that is connected to the side frame 51. The drive motor 37, in this embodiment, is separably connected to the housing 61 of the oscillating transmission 42. Also, as may be seen in FIG. 5, a drive control system 63 for the drive motor 37 is depicted.

Reference will now be made again to FIGS. 1 to 4. The inking unit 06 further has a washing device 26, which can comprise, for example, automatic washing solution supply lines, which are not specifically depicted, a washing blade 27, which can be engaged against a roller in the inking unit, and especially against the secondary ink flow distribution roller 18 of the inking unit 06, and a drip pan 28. This washing device 26 is mounted so as to engageable against the secondary ink flow distribution roller 18, for example by pivoting, for the purpose of cleaning the inking unit 06. Alternatively, or additionally, a second washing device 38, which applies a washing solution to the ink flow dividing roller 16, can be provided. This second washing device 38 preferably sprays its washing solution onto the circumferential surface of the rotating ink flow dividing roller 16. This alternative or supplementary washing device 38 cooperates in the washing process with at least the washing blade 27 that can be engaged against the secondary ink flow distribution roller 18 of the inking unit 06.

To make it possible for only one of the washing devices 26; 38, or for both washing devices 26; 38 together, to be used to simultaneously clean the dampening unit 07, in addition to cleaning the inking unit 06, it is provided that at least one of the rollers 08; 09; 11; 14; 16; 17; 18; 21; 22; 23 of the inking unit 06 and/or of the dampening unit 07 can be displaced. The result is that the inking unit 06 and/or the dampening unit 07, at least, have one shared roller train, allowing them to also transport the washing solution to the dampening unit 07, or from the dampening unit 07 back to the inking unit 06.

Ink forme roller 08 of the inking unit 06 and dampening forme roller 23 of the dampening unit 07, which are each already arranged very close to the respective adjacent dampening unit 07 or inking unit 06, are particularly well suited for use as displaceable rollers. The displaceable in forme roller 08 or the displaceable dampening forme 23 can be arranged so as to shift, for example, for its displacement. However, it is preferably pivotably arranged, especially so as to pivot around the axis of the respective adjacent primary ink flow distribution roller 17 or dampening smoothing roller 22 with which it cooperates directly in print operation and with which it is also drive connected.

In FIG. 1, dashed lines indicate that either the ink forme roller 08 can be arranged so as to pivot around the axis of the primary ink flow distribution roller 17 on a pivoting lever mechanism 29, or that the dampening forme roller 23 can be arranged so as to pivot around the rotational axis of the dampening smoothing roller 22 on a pivoting lever mechanism 31. In a further alternative embodiment of the present invention, both rollers 08; 23 could be displaceable, if this double displacement is necessary to bridge a greater distance, for example. In FIG. 1, the two displaceable rollers 08 and 23 are shown in their respective operating positions during print operation.

FIG. 2 depicts the embodiment of the present invention in which the dampening forme roller 23 of the dampening unit 07 is pivotably, or is displaceably, mounted. FIG. 2 shows the displaceable dampening forme roller 23 in its displaced position, or in other words, in its washing position. In this position, the dampening forme roller 23 is pivoted away from the forme cylinder 02 and is out of its operating position close to the printing couple cylinder. It is now engaged in a position against the ink forme roller 08 of the inking unit 06, and is more distant from the printing couple cylinder, thereby forming a shared roller train of the inking unit 06 and the dampening unit 07, for example with rollers 08; 17; 16; 18; 23; 22; 21. The inking unit 06 and dampening unit 07 can now be washed together using the same washing device 26 or 38 or using both washing devices 26 and 38.

FIG. 3 depicts an alternative embodiment of the present invention, in which the ink forme roller 08 of the inking unit 06 is pivotably, or is displaceably, mounted. FIG. 3 shows the displaceable ink forme roller 08 in its displaced position, or in other words, in its washing position. In this position, the ink forme roller 08 is pivoted away from the forme cylinder 02 and is out of its operating position close to the printing couple cylinder. It is now engaged in a position against the dampening forme roller 23 of the dampening unit 07, and is more distant from the printing couple cylinder, thereby again forming a shared roller train of the inking unit 06 and the dampening unit 07, again with rollers 08; 17; 16; 18; 23; 22; 21, for example. Inking unit 06 and dampening unit 07 can be washed together using the same washing device 26 or 38 or using both washing devices 26 and 38.

FIG. 4 shows an operating status of the printing couple 01, in which all dampening forme roller 23; and inking forme rollers 08; 09; 11 are all in the "print off" position. In other words, they are all spaced somewhat from the forme cylinder 02. The two forme rollers 08; 23 are moved into their bridge position in which inking unit 06 and dampening unit 07 are connected to one another, thus allowing the dampening unit 07 to be washed by using the washing device 26 or 38 that is arranged on the inking unit 06, or by using both washing devices 26; 38, via the bridge that is formed in this manner.

As was described above, the displaceable ink forme roller 08 and dampening forme roller 23 are each structured such that these rollers 08; 23 are adjusted to, or can be moved to the print-on setting and to the print-off setting via their respective bearings, which bearings are capable of radial travel and which can be actuated via the actuators 24. These rollers 08; 23 can be pivoted in order to switch from an operating position, their position during print operation, to a washing position, their position during washing operation, and vice versa.

While preferred embodiments of a printing couple of a rotary printing press and a method for washing a dampening unit of a printing couple in accordance with the present invention have been set forth fully and completely hereinabove, it will be apparent to one of skill in the art that various changes in, for example, the specific structures of the forme cylinder and the transfer cylinder, the operation of the printing presses, the types of ink used, and the like could be made without departing from the true spirit and scope of the present invention which is accordingly to be limited only by the appended claims.

The invention claimed is:

1. Printing couple (01) of a rotary printing press with a forme cylinder (02), an inking unit (06) that cooperates with the forme cylinder (02) and has a plurality of rollers (08; 09; 11; 13; 14; 16; 17; 18), a dampening unit (07) that cooperates with the forme cylinder (02) and has a plurality of rollers (21; 22; 23), and at least one washing device (26; 38) that cooperates with one of the rollers (08; 09; 11; 13; 14; 16; 17; 18; 21; 22; 23) to wash the inking unit (06) and/or the dampening unit (07), wherein the inking unit (06) has a plurality of ink forme rollers (08; 09; 11), which during print operation are engaged directly against the forme cylinder (02), wherein the dampening unit (07) has at least one dampening forme roller (23), which during print operation is engaged directly against the forme cylinder (02), in that in the washing position, an ink forme roller (08) of the plurality of ink forme rollers (08; 09; 11) and the dampening forme roller (23) are engaged directly against one another, characterized in that at least the ink forme roller (08) or dampening forme roller (23), which can be displaced between an initial position and a washing position, connects rollers (08; 09; 11; 13; 14; 16; 17; 18) of the inking unit (06) and rollers (21; 22; 23) of the dampening unit (07) to form a shared roller train when in its washing position.

2. Printing couple (01) of claim 1, characterized in that in the washing position, rollers (08; 09; 11; 13; 14; 16; 17; 18) of the inking unit (06) and a plurality of dampening unit rollers (21; 22; 23) of the dampening unit (07) are connected to form a shared roller train.

3. Printing couple (01) of claim 1, characterized in that when the ink forme roller (08) is in its washing position, it is not in contact with the forme cylinder (02).

4. Printing couple of claim 1, characterized in that when the dampening forme roller (23) is in its washing position, it is not in contact with the forme cylinder (02).

5. Printing couple of claim 1, characterized in that the displaceable ink forme roller (08) or dampening forme roller (23) is mounted so as to be pivotable between its initial position and its washing position.

6. Printing couple of claim 5, characterized in that the displaceable ink forme roller (08) or dampening forme roller (23) is mounted so as to be pivotable around the rotational axis of an adjacent roller (17 or 22, respectively).

7. Printing couple of claim 1, characterized in that the inking unit (06) and the dampening unit (07) is not connected via inking rollers or dampening rollers during print operation.

8. Printing couple of claim 1, characterized in that the dampening unit (07) is embodied as a dampening unit (07) which applies dampening agent in a contactless manner.

9. Printing couple of claim 1, characterized in that at least the displaceable ink forme roller (08) or dampening forme roller (23) is arranged so as to be capable of radial travel, wherein the radial travel refers to the eccentric displacement of the axis of this ink forme roller (08) or dampening forme roller (23), or of at least one end of this ink forme roller (08) or dampening forme roller (23), in relation to a bearing point belonging to the ink forme roller (08) or dampening forme roller (23).

10. Printing couple of claim 9, characterized in that the displaceable inking unit roller (08) or dampening unit roller (23) is capable of radial travel with respect to a position in which it cooperates with the forme cylinder (02) and a position that is offset from the same, and is also pivotable between the first position and the washing position.

11. Printing couple of claim 1, characterized in that the forme cylinder (02) is a plate cylinder (02).

12. Printing couple of claim 1, characterized in that the printing couple (01) is embodied as a printing couple (01) of a satellite printing unit.

13. Printing couple of claim 1, characterized in that the printing couple (01) is embodied as a printing couple (01) of a web-fed rotary offset printing press.

14. Printing couple of claim 1, characterized in that the at least one washing device (26; 38) comprises a washing blade (27), which cooperates with a roller (18).

15. Printing couple of claim 14, characterized in that the washing blade (27) or the roller (18) is pivotabty mounted.

16. Printing couple of claim 14, characterized in that the roller (18) that cooperates with the washing blade (27) is a distribution roller (18) of the inking unit (06).

17. Printing couple of claim 1, characterized in that the at least one displaceable ink forme roller (08) or dampening forme roller (23) can be moved by means of at least one actuator (24), which is assigned exclusively to this roller (08; 23).

18. Printing couple of claim 17, characterized in that the rollers (09; 23; 08) that are directly adjacent to the displaceable ink forme roller (08) or dampening forme roller (23) can be moved by means of at least one actuator (24), which is assigned exclusively to these rollers (09; 23; 08).

19. Printing couple of claim 1, characterized in that the inking unit (06) comprises at least two distribution rollers (17; 18).

20. Printing couple of claim 19, characterized in that at least one of the distribution rollers (17; 18) is driven by a drive motor (37) which has no positive connection with the forme cylinder (02).

21. Printing couple of claim 19, characterized in that the at least two distribution rollers (17; 18) are driven by a shared drive motor (37).

22. Printing couple of claim 21, characterized in that the drive motor (37) actuates each of the two distribution milers (17; 18) to axial movement.

23. Printing couple of claim 22, characterized in that the drive motor (37) actuates at least one of the two distribution rollers (17; 18) to rotational movement.

24. Printing couple of claim 20, characterized in that at least one of the two distribution rollers (17; 18) is coupled with the drive motor (37) via a transmission (42).

25. Printing couple of claim 24, characterized in that the transmission (42) is embodied as an oscillating transmission (42).

26. Printing couple of claim 21, characterized in that the drive motor (37) actuates both distribution rollers (17; 18) into rotation together only during the washing process.

27. Printing couple of claim 1, characterized in that the inking unit (06) has exactly three ink forme rollers (08; 09; 11).

28. Printing couple of claim 1, characterized in that the dampening unit (07) has exactly one dampening forme roller (23).

29. Printing couple of claim 1, characterized in that each of the ink forme rollers (08; 09; 11) can be moved via at least one actuator which is assigned to move only, that specific ink forme roller (08; 09; 11).

30. Printing couple of claim 1, characterized in that the dampening forme roller (23) can be moved via at least one actuator which is assigned to move only that specific dampening forme roller (23).

31. Printing couple of claim 29, characterized in that each ink forme roller (08; 09; 11) or ink forme roller (08; 09; 11) can be moved by at least two actuators (24).

32. Printing couple of claim 31, characterized in that both ends of each ink forme roller (08; 09; 11) or dampening forme roller (21; 22; 23) are arranged in a roller socket, and in that the at least one actuator is arranged in said roller socket.

33. Printing couple of claim 1, characterized in that two oscillating distribution rollers (17; 18) are provided, and in that two ink forme rollers (09; 11) are engaged directly against the one distribution roller (18), and in that one ink forme roller (08) is engaged directly against the other distribution roller (17).

34. Printing couple of claim 1, characterized in that at least the inking unit (06) is driven by a drive motor (34), which is driven without a positive connection with the forme cylinder (02).

35. Printing couple of claim 2, characterized in that in the washing position, rollers (08; 09; 11; 13; 14; 16; 17; 18) of the inking unit (06) and three dampening unit rollers (21; 22; 23) of the dampening unit (07) are connected to form a shared roger train.

36. Printing couple of claim 35, characterized in that in the washing position, rollers (08; 09; 11; 13; 14; 16; 17; 18) of the inking unit (06) and dampening distribution roller (21), smoothing roller (22) and dampening forme roller (23) of the dampening unit (07) are connected to form a shared roller train.

37. Method for washing a dampening unit (07) of a printing couple (01) of a rotary printing press, which has an inking unit (06) that cooperates with a forme cylinder (02) and a dampening unit (07) that cooperates with the forme cylinder (02), wherein at least one displaceable ink forme roller (08) or dampening forme roller (23) is moved into a washing position, in which it defines a shared roller train between inking unit (06) and dampening unit (07), and wherein when the inking unit (06) is washed, the dampening unit (07) is washed at the same time with three dampening unit rollers (21; 22; 23) via the displaced roller (08; 23), wherein the ink forme roller (08) and the dampening forme roller (23) are engaged directly against one another.

38. Method of claim 37, characterized in that the displaceable roller (08; 23) is a forme roller (08; 23) of the inking unit (06) or of the dampening unit (07).

39. Method of claim 37, characterized in that the displaceable ink forme roller (08) or dampening forme roller (23) is moved from an operating position, in which it is close to the printing couple cylinder, to a washing position, in which it is more distant from the printing couple cylinder.

40. Method of claim 37, characterized in that in the washing position, rollers (08; 09; 11; 13; 14; 16; 17; 18) of the inking unit (06) and a plurality of dampening unit rollers (21; 22; 23) of the dampening unit (07) are connected to form a shared roller train.

41. Method of claim 40, characterized in that in the washing position, rollers (08; 09; 11; 13; 14; 16; 17; 18) of the inking unit (06) and three dampening unit rollers (21; 22; 23) of the dampening unit (07) are connected to form a shared roller train.

42. Method of claim 40, characterized in that in the washing position, rollers (08; 09; 11; 13; 14; 16; 17; 18) of the inking unit (06) and dampening distribution roller (21), smoothing roller (22) and dampening forme roller (23) of the dampening unit (07) are connected to form a shared roller train.

* * * * *